US010988353B1

(12) United States Patent
Kelly

(10) Patent No.: US 10,988,353 B1
(45) Date of Patent: Apr. 27, 2021

(54) POWER WINCH EQUIPMENT CRANE WITH HINGE MEMBERS

(71) Applicant: Michael S. Kelly, Louisville, TN (US)

(72) Inventor: Michael S. Kelly, Louisville, TN (US)

( * ) Notice: Subject to any disclaimer, the term of this patent is extended or adjusted under 35 U.S.C. 154(b) by 0 days.

(21) Appl. No.: 17/068,221

(22) Filed: Oct. 12, 2020

Related U.S. Application Data

(60) Provisional application No. 62/932,162, filed on Nov. 7, 2019.

(51) Int. Cl.
*B66C 23/44* (2006.01)
*B66D 1/28* (2006.01)
*B66D 1/12* (2006.01)

(52) U.S. Cl.
CPC ..... *B66C 23/44* (2013.01); *B66D 1/12* (2013.01); *B66D 1/28* (2013.01); *B66C 2700/0378* (2013.01)

(58) Field of Classification Search
CPC ... B66C 23/44; B66C 2700/0378; B66D 1/12; B66D 1/28
See application file for complete search history.

(56) References Cited

U.S. PATENT DOCUMENTS 122,973 A * 1/1872 Spragg et al. ..... B61L 29/02 160/146
1,901,566 A * 3/1933 Presbrey ..... B66C 23/36 414/592
2,259,553 A 10/1941 Clapper
2,298,199 A 10/1942 Court et al.
2,336,965 A * 12/1943 Shoemaker ..... B66C 23/36 212/299
2,366,115 A 12/1944 Kuch et al.
2,381,731 A 8/1945 Erdahl
2,519,974 A 8/1950 Mork
2,713,218 A 7/1955 Dyer
2,746,612 A 5/1956 Wirz
2,772,004 A 11/1956 Noble
2,787,383 A 4/1957 Antos et al.
2,794,382 A 6/1957 Ellson
(Continued)

FOREIGN PATENT DOCUMENTS

CA 571346 A 2/1959
CA 892881 A 2/1972
(Continued)

*Primary Examiner* — Michael E Gallion
(74) *Attorney, Agent, or Firm* — Pitts & Lake, P.C.

(57) ABSTRACT

A power winch equipment crane system to be used with a tractor roll bar, the system including a winch support bar configured to be generally U-shaped having two side portions and a middle portion connecting the two side portions, a power winch attached to the winch support bar proximate a midpoint of the middle portion of the winch support bar, and hinge members provided respectively proximate each end of the winch support bar and configured to couple the winch support bar to the tractor roll bar in a pivoting arrangement, the hinge members configured such that the winch support bar is pivotable between a substantially vertical position when not in use, and a substantially horizontal position in which the power winch is positioned at a point spaced back from the tractor so as to be located over an implement that is attachable to the tractor.

20 Claims, 8 Drawing Sheets

(56) References Cited

U.S. PATENT DOCUMENTS

| | | | | |
|---|---|---|---|---|
| 3,229,830 | A * | 1/1966 | Smith | B60P 1/5438 414/542 |
| 3,266,636 | A | 8/1966 | Dom | |
| 3,390,795 | A * | 7/1968 | Mannix | B60P 1/5423 414/461 |
| 3,473,679 | A | 10/1969 | Weichel | |
| 3,570,614 | A | 3/1971 | Del Bagno | |
| 3,598,347 | A * | 8/1971 | Marburger | B23Q 9/00 248/654 |
| 3,818,551 | A | 6/1974 | Coughran, Jr. | |
| 3,888,368 | A * | 6/1975 | Hawkins | B66C 23/44 414/563 |
| 3,899,089 | A | 8/1975 | Wardlaw | |
| 3,901,328 | A | 8/1975 | Stanfield | |
| 4,042,116 | A | 8/1977 | Bertolino | |
| 4,067,471 | A * | 1/1978 | Roatcap | B62D 49/02 172/439 |
| 4,172,688 | A | 10/1979 | Cecchi et al. | |
| 4,222,186 | A | 9/1980 | Molby | |
| 4,316,617 | A | 2/1982 | Flaugh | |
| 4,484,760 | A | 11/1984 | Rach | |
| 4,838,753 | A | 6/1989 | Gehman et al. | |
| 4,846,624 | A | 7/1989 | Hohn | |
| 4,929,143 | A | 5/1990 | Dohnalik | |
| 5,029,650 | A | 7/1991 | Smit | |
| 5,169,279 | A * | 12/1992 | Zimmerman | A01B 59/062 172/439 |
| 5,314,289 | A * | 5/1994 | O'Leary | B60P 1/14 414/494 |
| 5,347,939 | A | 9/1994 | Hood, Jr. et al. | |
| 5,348,172 | A | 9/1994 | Wilson | |
| 5,393,194 | A * | 2/1995 | Smith | B60P 1/00 212/298 |
| 5,722,677 | A | 3/1998 | Lichter et al. | |
| 5,727,803 | A | 3/1998 | Johnson | |
| 6,257,347 | B1 * | 7/2001 | Campisi | A01B 59/068 172/439 |
| 6,349,959 | B2 | 2/2002 | Schlegel et al. | |
| 6,481,694 | B2 * | 11/2002 | Kozak | B62B 1/14 254/325 |
| 6,533,042 | B1 | 3/2003 | Marine, Sr. et al. | |
| 6,612,549 | B1 * | 9/2003 | Woods, Jr. | B66C 23/44 254/323 |
| 6,981,834 | B1 * | 1/2006 | Henry | B66C 23/44 414/462 |
| 7,100,704 | B2 | 9/2006 | Potter | |
| 7,604,134 | B2 | 10/2009 | Lichinchi | |
| 8,690,514 | B2 | 4/2014 | Marola | |
| 9,434,582 | B2 * | 9/2016 | Arthur | B66C 23/00 |
| 9,775,276 | B2 | 10/2017 | Hyder | |
| 9,963,329 | B1 * | 5/2018 | Guess, Jr. | B66C 23/44 |
| 10,160,395 | B2 * | 12/2018 | Robinson | B66F 11/04 |
| 10,172,275 | B2 | 1/2019 | Totten et al. | |
| 2003/0039535 | A1 * | 2/2003 | Gourand | B66C 23/44 414/543 |
| 2005/0023012 | A1 | 2/2005 | Bowden | |
| 2007/0166138 | A1 * | 7/2007 | Brooks | B66F 9/082 414/471 |
| 2007/0221600 | A1 * | 9/2007 | Davis | B66C 23/44 212/270 |
| 2009/0230071 | A1 | 9/2009 | Thompson | |
| 2010/0200822 | A1 * | 8/2010 | Kitchens, Sr. | B66D 3/18 254/326 |
| 2011/0206488 | A1 * | 8/2011 | Windsor | B66C 23/44 414/462 |
| 2013/0087521 | A1 * | 4/2013 | Walker | B66C 23/44 212/255 |
| 2016/0122973 | A1 | 5/2016 | Lyle et al. | |
| 2016/0167933 | A1 * | 6/2016 | Birch | B66C 23/44 254/326 |
| 2016/0280516 | A1 * | 9/2016 | Rieger | B62B 3/02 |
| 2017/0055430 | A1 * | 3/2017 | Steiner | B62D 49/065 |
| 2020/0047655 | A1 * | 2/2020 | Urbanick | B60P 1/5428 |
| 2020/0165110 | A1 * | 5/2020 | Wilson | A01M 31/006 |

FOREIGN PATENT DOCUMENTS

| | | | |
|---|---|---|---|
| CN | 201087999 | Y | 7/2008 |
| CN | 202528985 | U | 11/2012 |
| EP | 2592042 | A1 | 5/2013 |
| GB | 642680 | A | 9/1950 |
| GB | 745243 | A | 2/1956 |
| GB | 890630 | A | 3/1962 |
| GB | 1267645 | A | 3/1972 |

* cited by examiner

POWER WINCH EQUIPMENT CRANE WITH HINGE MEMBERS

CROSS-REFERENCE TO RELATED APPLICATIONS

This application claims the benefit of U.S. Provisional Patent Application Ser. No. 62/932,162, filed on Nov. 7, 2019, which is incorporated herein in its entirety by reference.

FIELD OF INVENTION

The present general inventive concept relates to an equipment crane system for a farm vehicle, and, more particularly, to a pivotable power winch equipment crane which may be affixed to a vehicle roll bar to aid in the coupling and decoupling of heavy equipment to the vehicle.

BACKGROUND

Farm vehicles such as tractors are used for a variety of heavy work applications. A host of different work apparatuses may be attached to, and powered by, the tractor. For example, a tractor may be provided with a backhoe attachment, a rototiller, a plow, a hay baler, or any number of other such devices/systems. However, being designed for heavy duty, most of all of these attachments are themselves very heavy, and being able to lift them into place for all the necessary couplings to the tractor can be very difficult, especially for a lone user. For example, some large tillers need to be lifted into position for hookup to a 3-point hitch. Additionally, a complicated series of maneuvers is often required, for which a relatively long time in which the implements must be lifted. Attempting such a procedure by hand creates a situation in which the user could be seriously injured. Some approaches to this problem involve attaching a hoist to a beam of a structure such as a barn to mechanically lift the implements into place, or installing a quick hitch to the back of the tractor. However, these approaches are problematic. Arranging and relying on a barn hoist is both complicated and limiting as far as having to position the implements to be attached to the tractor, leading to some of the same problems for a single user. The use of quick hitches changes the arrangement of the implement arms, and can be cumbersome, obtrusive, and lacking in aesthetics. Therefore, an easier and more convenient way to maneuver heavy equipment into place for connection to the tractor would be desirable.

BRIEF SUMMARY

According to various example embodiments of the present general inventive concept, a power winch support is provided that is selectively positionable between a stored position and a position to allow a piece of equipment to be lifted by the power winch to a desirable position to be hooked to the tractor.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a power winch equipment crane system to be used with a tractor roll bar, the system including a winch support bar configured to be generally U-shaped having two side portions and a middle portion connecting the two side portions, a power winch attached to the winch support bar proximate a midpoint of the middle portion of the winch support bar, and hinge members provided respectively proximate each end of the winch support bar and configured to couple the winch support bar to the tractor roll bar in a pivoting arrangement, the hinge members configured such that the winch support bar is pivotable between a substantially vertical position when not in use, and a substantially horizontal position in which the power winch is positioned at a point spaced back from the tractor so as to be located over an implement that is attachable to the tractor.

The foregoing and/or other aspects and advantages of the present general inventive concept may also be achieved by providing a power winch equipment crane system to be used with a tractor roll bar, the system including a winch support bar configured to be generally U-shaped having two side portions and a middle portion connecting the two side portions, a power winch attached to the winch support bar proximate a midpoint of the middle portion of the winch support bar, hinge members provided respectively at each end of the winch support bar and configured to secure the winch support bar to a bracket on the tractor roll bar, the hinge members configured to form a pivoting connection to the winch support bar such that the winch support bar is pivotable between a substantially vertical position when not in use, and a substantially horizontal position in which the power winch is positioned at a point spaced back from the tractor, stop members extending from each end of the winch support bar and configured to contact the tractor roll bar when in the substantially horizontal position to brace the winch support bar against the tractor roll bar, and at least one movable securing member attached to the winch support bar and configured to be selectively positioned so as to contact the tractor roll bar to hold the winch support bar in the substantially vertical position.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1A:
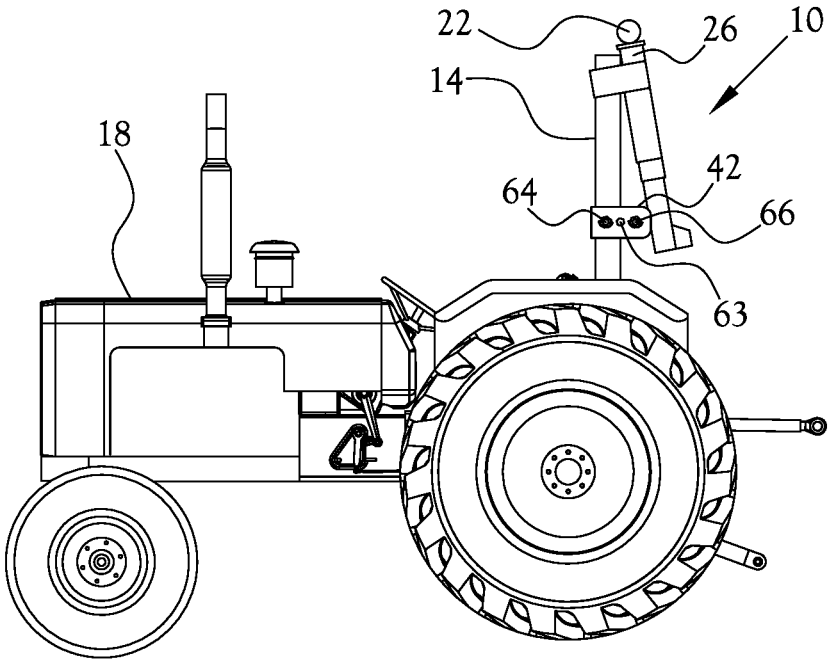
FIGS. 1A-B illustrate a power winch equipment crane system according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various example embodiments of the present general inventive concept provide a power winch support system, or power winch equipment crane system, which allows a user to lower a power winch down over a tractor implement and lift the implement for easier and more convenient attachment to the tractor. Thus, the power winch is positionable at a point extending back and away from the tractor so as to be placed over the implement for a lifting and lowering operation. The system then allows the user to move the power winch back to a stowed position that is not obtrusive to the operation of the tractor. Many modern tractors are provided with a roll over protection system (ROPS), which may be referred to herein as a tractor roll bar, or simply a roll bar. In various example embodiments of the present general inventive concept, the power winch may be attached to a support bar that is similar in shape to the tractor roll bar, and which can be connected to the tractor roll bar and rotated to a vertical position that is aesthetically pleasing, as well as out of the way of other equipment operations, when the power winch is not in use. Such systems may be formed integrally with the tractor roll bar, or may be retro-fitted onto existing roll bars. When the user desires to use the power winch, the support bar can simply be moved down to position the power winch over the implement to be lifted, allowing the implement to be hooked up to the tractor connections easily and conveniently by one person. Although the term "tractor" is used in most of the descriptions herein, it is understood that various embodiments of the present general inventive concept may be used with other vehicles as well. It is also noted that the term "implement" is used to generally refer to a number of systems/attachments that may be connected to and utilized by a tractor, such as, for example, a backhoe attachment, a rototiller, a plow, a hay baler, and so on. These implements typically have various pin and linkage connections to be connected to the tractor for proper operation, and by utilizing the power winch system of the present general inventive concept these connections may be conveniently made by a single user. Thus, according to various example embodiments of the present general inventive concept, a power winch support is provided that is selectively positionable between a stored or stowed position and a position to allow a piece of equipment, generally referred to herein as an implement, to be lifted by a power winch, which is installed on the power winch support, to a desirable position to be hooked to the tractor.

Figure 1B:
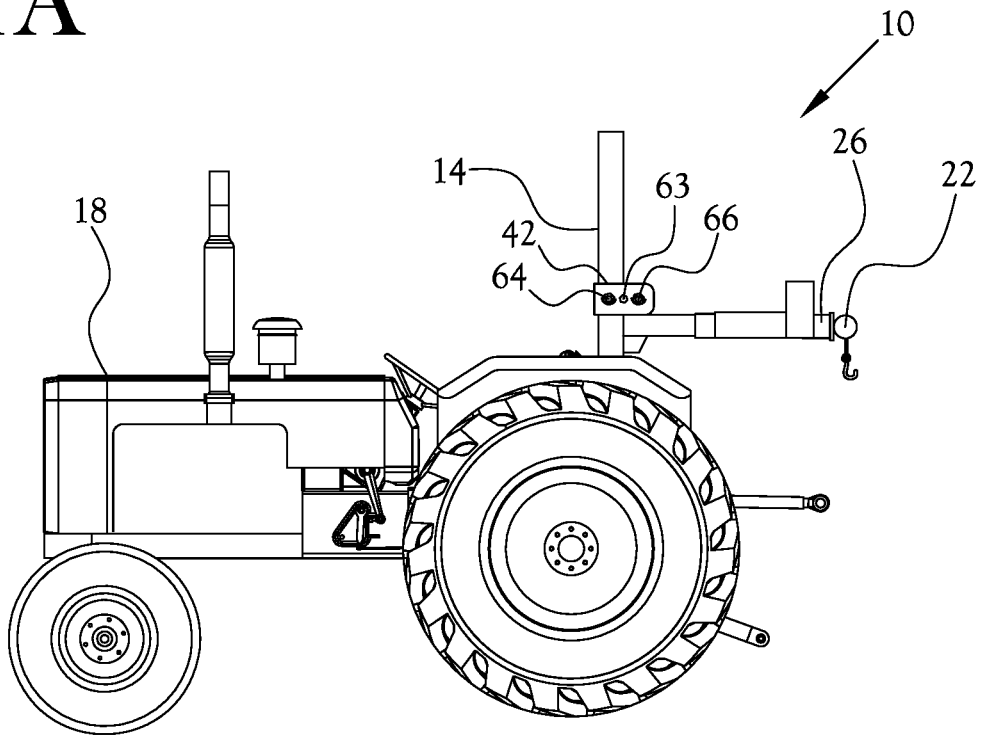

FIGS. 1A-B illustrate a power winch equipment crane system according to an example embodiment of the present general inventive concept. As illustrated in FIG. 1A, a power winch equipment crane system 10, which may be referred to herein as a power winch support system or simply a winch support system, is attached to the tractor roll bar 14 of a tractor 18 in a vertical or stowed position when not in use. The power winch support system 10 includes a power winch 22 mounted on a winch support bar 26 that may be configured in a shape substantially similar to that of the tractor roll bar 14, so as to at least somewhat blend in with the tractor roll bar 14 in an aesthetic sense, and to move the winch support bar 26 and winch 22 out of the way of other operations, when not in use. Thus, when not in use, the winch support bar 26 is oriented in a somewhat vertical orientation, with the power winch 22 positioned proximate a center portion of the tractor roll bar 14. The stowed position/orientation of the winch support bar 26 is not just for aesthetic purposes, but also serves a functional purpose of moving the winch support bar 26 out of the way when not in use. For example, an advantage of the shape of the winch support bar 26 is that when a backhoe is attached to the tractor, an operator may easily operate the backhoe without obstruction, as the operator typically faces backward on the tractor to use the backhoe. Thus, when the winch support bar 26 is in the upright/stowed position, it is safely out of the way and takes up essentially the same space as the tractor roll bar 14. As illustrated in FIG. 1B, when a user wishes to use the power winch 22 to aid in the attaching and/or detaching of an implement to be connected to the tractor 18, the winch support bar 26 is rotated back and down into a substantially horizontal orientation, placing the power winch 22 at a position rear of the tractor 18 and the various connection points of the tractor 18, so that a winch cable having a hook or other such attachment member can be lowered to a point over the implement to raise the connection end of the implement to a position that makes it easier for a single user to perform the various maneuvers and connections to attach the implement to the tractor 18. After the operations are performed, the user can detach the winch 22 cable from the implement and raise the winch support bar 26 back to the raised, or stowed, position.

Figure 2B:
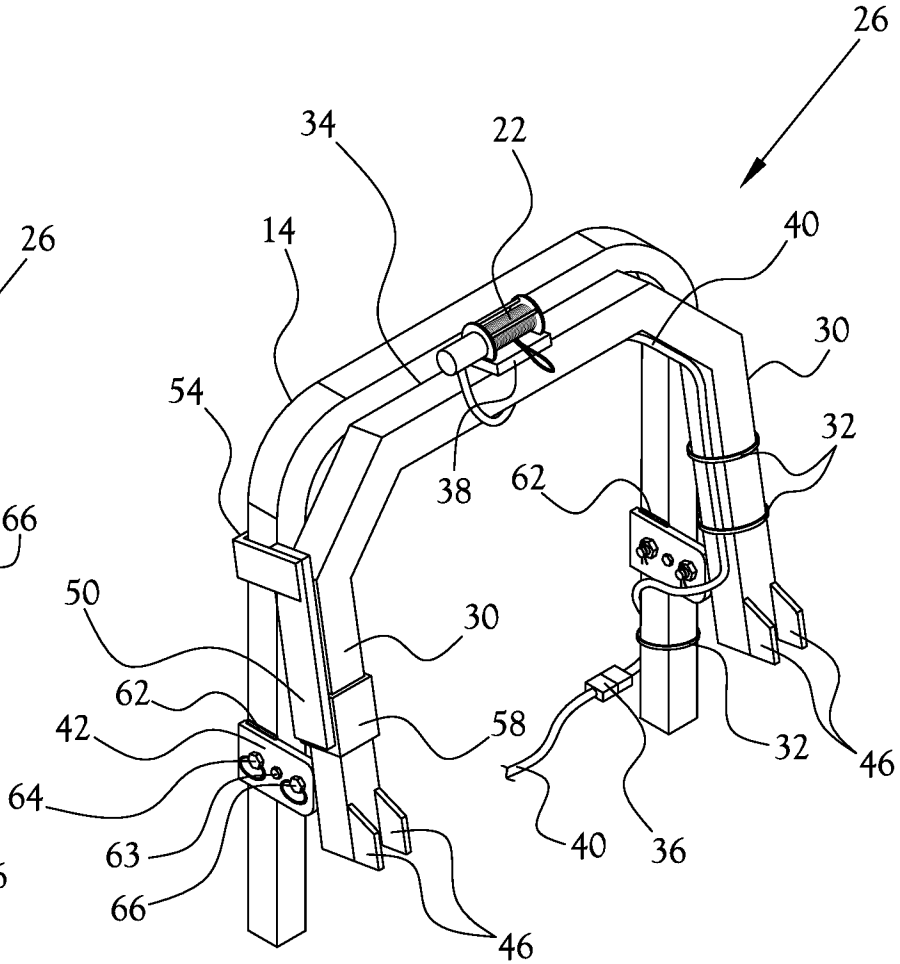
FIGS. 2A-B illustrate exploded and assembled views of a power winch equipment crane system and a tractor roll bar according to an example embodiment of the present general inventive concept.
Figure 2A:
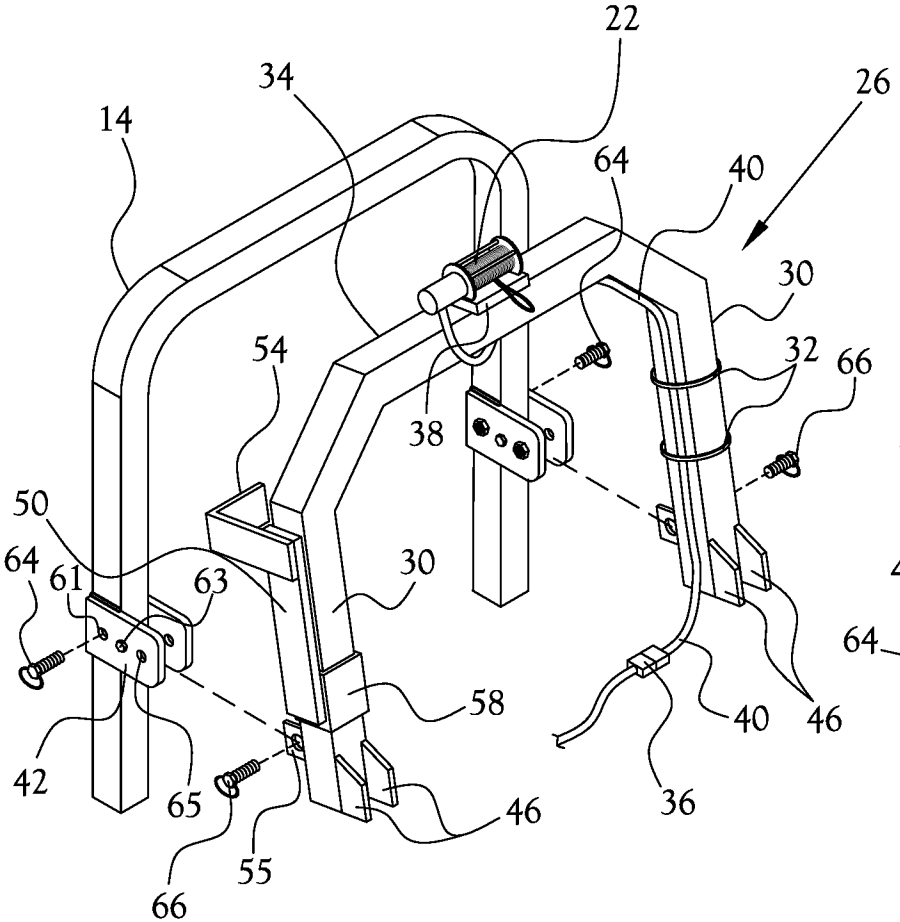

FIGS. 2A-B illustrate exploded and assembled views, respectively, of a power winch equipment crane system and a tractor roll bar according to an example embodiment of the present general inventive concept. FIG. 2A illustrates the power winch support system 10 of this example embodiment, and the tractor roll bar 14 to which the system 10 is to be attached. FIG. 2B illustrates the winch support system 10 attached to the tractor roll bar 14, and oriented in the upright or stowed orientation. As illustrated in FIG. 2A, the winch support bar 26 may be generally U-shaped so as to resemble the shape of the tractor roll bar 14. Such a configuration is not only functional, in that it makes it easy to lower the winch support bar 26 to place the winch 22 over the tractor implement or equipment that is to be attached to the tractor 18, but is also aesthetically pleasing since it is not as obtrusive and somewhat blends in with the tractor roll bar 14 when the winch support 26 is rotated to a vertical position when not in use. The winch support bar 26 includes two side portions 30 extending to the respective ends of the winch support bar 26, and a middle portion 34, or summit portion, between the two side portions 30. The power winch 22 is attached to the middle portion 34 of the winch support bar 26 proximate a mid-point thereof, so that when the winch support bar 26 is lowered for use of the system 10, the winch 22 will be at least somewhat centered on the longitudinal axis of the tractor 18. In various example embodiments the power winch 22 may be mounted on a mounting plate 38 that is attached to the middle portion 34 of the winch support bar 26, and a power supply line 40 may be run along one of the side portions 30 of the winch support bar 26 to supply power from the battery of the tractor 18 to the power winch 22. As illustrated in FIGS. 2A-2B, the power supply line 40 may be adhered to various portions of the winch support bar by tie-downs 32 to avoid interfering with the movement of the support bar 26. Further, the power supply line 40 may be provided with electrical quick connects 36 for a fast and convenient electrical disconnect when removing the winch support bar 26 from the tractor roll bar 14. The system of the example embodiment illustrated in FIGS. 2A-2B, and which is illustrated in various other drawings herein, is attached to ROPS hinge brackets 42 that are already provided to the tractor roll bar 14. In such a ROPS, the roll bar 14 is designed to be collapsible such that a top portion folds over to contact the bottom portion. To actuate this action, the ROPS hinge brackets 42 have first set bolt holes 61 in which set bolts 64 are positioned when the roll bar 14 is upright. The set bolts 64 pass through corresponding holes in the top portion of the roll bar 14. By removing the set bolts 64 from the first set bolt holes 61, the top portion of the roll bar 14 can be rotated downward, about ROPS hinge pins 63 provided in the brackets 42, so that the set bolt holes in the roll bar 14 align with second set bolt holes 65 in the brackets 42. The set bolts 64 can then be placed in the second set bolt holes 65 to secure the roll bar 14 in the folded position. The power winch equipment crane system 10 illustrated in FIGS. 2A-B take advantage of the second set bolt holes 65 already provided in the ROPS brackets 42. Hinge members 55 are provided at each end of the winch support bar 26 to couple the winch support bar 26 to the tractor roll bar 14 by receiving a pivot pin 66 through each of the second set bolt holes 65 and a corresponding hole in the hinge members 55. Thus, the winch support bar 26 uses the second set bolt holes 65 already provided to the roll bar 14 to form a hinge arrangement about which the winch support bar 26 can pivot. In this example embodiment, the ROPS hinge brackets 42 are attached to the tractor roll bar 14 by, for example, welding (a weld 62 is shown in this example embodiment). The set bolts 64 of the ROPS system are typically bolts secured in place with hair-pin-cotters, and in various example embodiments the pivot pins 66 may be a similar bolt and cotter arrangement, metric bolt, lynch pin, or other type of quick release pin to enable a user to be able to quickly and conveniently remove the winch support bar 26 from the brackets 42, and thus from the tractor roll bar 14. The pivot pin 66 of this example embodiment is a metric bolt that takes advantage of a welded nut already provided on the ROPS bracket 42, but other example embodiments may have a differently designed pivot pin. Thus, various example embodiments of the present general inventive concept may be retro-fitted to existing tractor roll bars. In other various example embodiments, the power winch equipment crane system may be retro-fitted to existing tractor roll bars that do not have the ROPS hinge bracket 42 by providing its own coupling bracket or other connection members, which may be referred to herein as coupling members, as they can couple the hinge members to the tractor roll bar, to be attached to the tractor roll bar 14 by welding or other arrangements. In various example embodiments the connection members may be connected to the roll bar in a variety of ways, such as welding, bolt-on, or the like, while keeping in mind the torque forces that will be produced when a heavy piece of equipment is being supported by the winch 22 that extends back from the roll bar 14 when in position for lifting. In this example embodiment, the hinge members 55 extend from a surface of the winch support bar 26 facing the tractor roll bar 14, and are configured to receive the pivot pins 66 to form the pivoting connection, but in various other example embodiments the pivot/hinge connection may be formed in different configurations, such as directly through the winch support bar 26 proximate the ends thereof. For example, some embodiments of the present general inventive concept may provide a collar configured to fit around the roll bar 14 with a connecting pin to provide the hinge arrangement/mounting point for the system. The example embodiment illustrated in FIGS. 2A-B includes a pair of stop members 46 provided proximate each end of the winch support bar 26, the stop members 46 configured to prevent back and downward rotation of the winch support bar 26 past a point at which the winch 22 is positioned for use. In this example embodiment, the stop members 46 are configured as flat members extending from a surface of the winch support bar 26 facing away from the tractor roll bar 14, at a position proximate the ends of the winch support bar 26, such that when the winch support bar 26 is rotated down to a substantially horizontal position for use of the power winch 22, the stop members 46 will abut the tractor roll bar 14 and prevent further downward rotation of the winch support bar 26. These stop members 46 brace the winch support bar 26 to provide further support for the power winch support system 10 when in use, as the various heavy implements being lifted/lowered by the winch 22 may produce significant downward forces on the winch support bar 26. It is understood that various other example embodiments of the present general inventive concept may provided different configurations for one or more of these components without departing from the scope of the present general inventive concept. The system 10 of FIGS. 2A-B include at least one securing member 50 attached to the winch support bar 26 to lock the winch support bar 26 in place in the stowed position. In this example embodiment the securing member 50 includes a sleeve portion 58 that wraps around at least part of one of the side portions 30 of the winch support bar 26, and which is configured to reciprocally slide along a length of the side portion 30. The securing member also includes a hook portion 54 configured to hook around and contact the surface of the tractor roll bar 14 facing away from the power winch support system 10 when the winch support bar 26 is locked in place. As will be discussed in more detail below in reference to FIGS. 4A-D, a user can use the sliding action of the securing member 50 to easily lock the winch support bar 26 in the upright position when the system 10 is not in use, and can also easily unlock the winch support bar 26 for movement by simply sliding the securing member 50 upward to a point at which the hook member 54 will not make contact with the tractor roll bar 14 when rotating the winch support bar 26 downward (away from the tractor roll bar 14). Although this example embodiment includes a reciprocally sliding securing member 50, various other example embodiments may provide a host of different securing members, such as, for example, a securing member having a contact or hook portion that may be selectively rotated about a position proximate the winch support bar 26 to a position that contacts the tractor roll bar 14 to hold the winch support bar 26 in place, or a latch type member that pivots to a catch on the tractor roll bar 14, and so on.

Figure 3A:
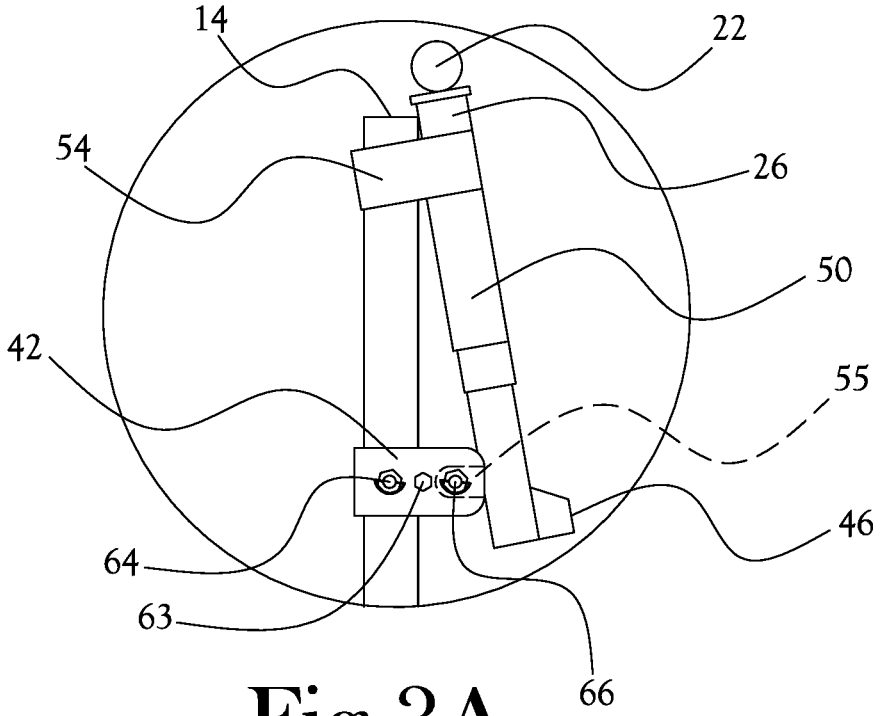
FIGS. 3A-B illustrate perspective views of a portion of the power winch equipment crane system of FIGS. 2A-B in the stowed position according to an example embodiment of the present general inventive concept.
Figure 3B:
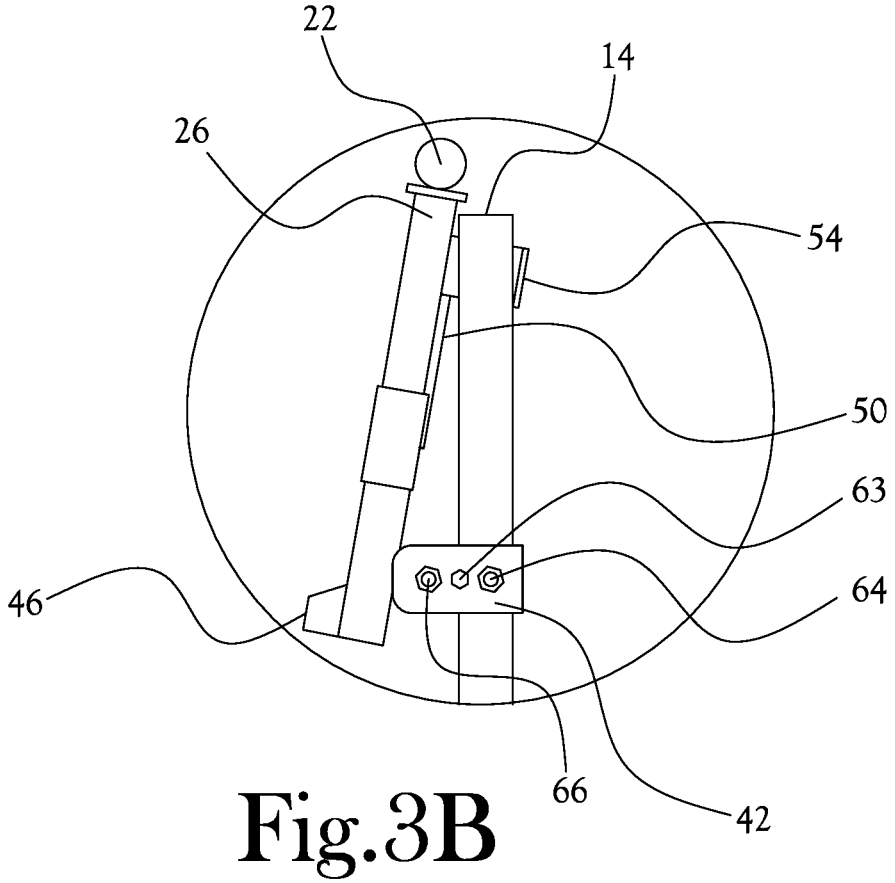
Figure 4B:
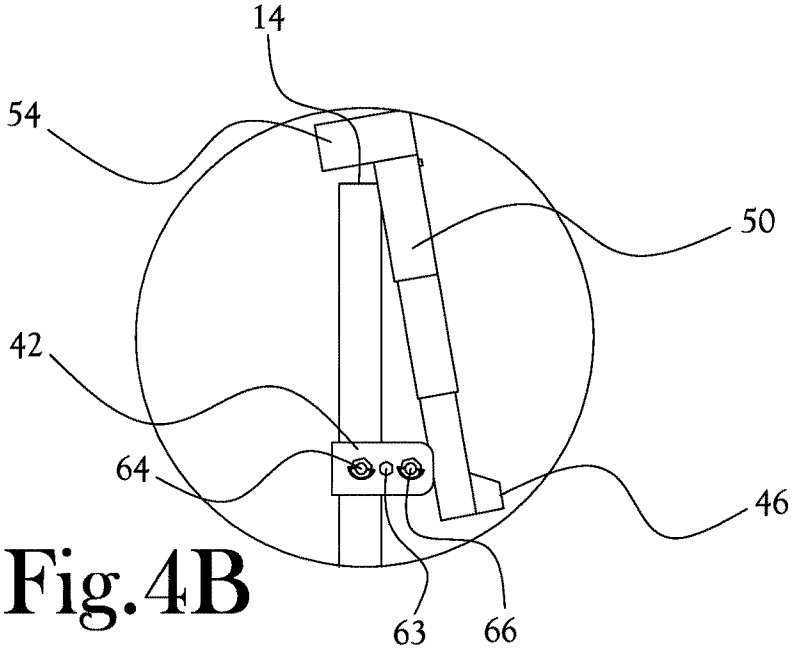
FIGS. 4A-D illustrate operations to position the power winch equipment crane system of FIGS. 3A-B according to an example embodiment of the present general inventive concept.
Figure 4A:
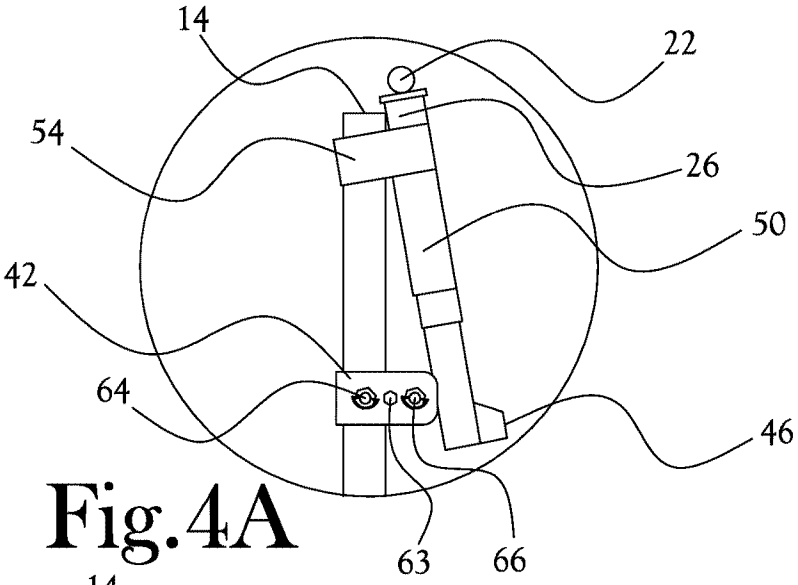
Figure 4D:
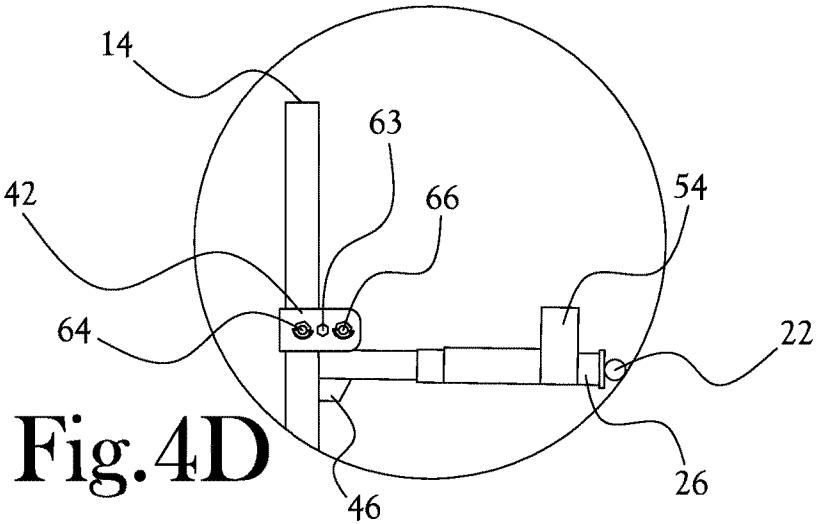
Figure 4C:
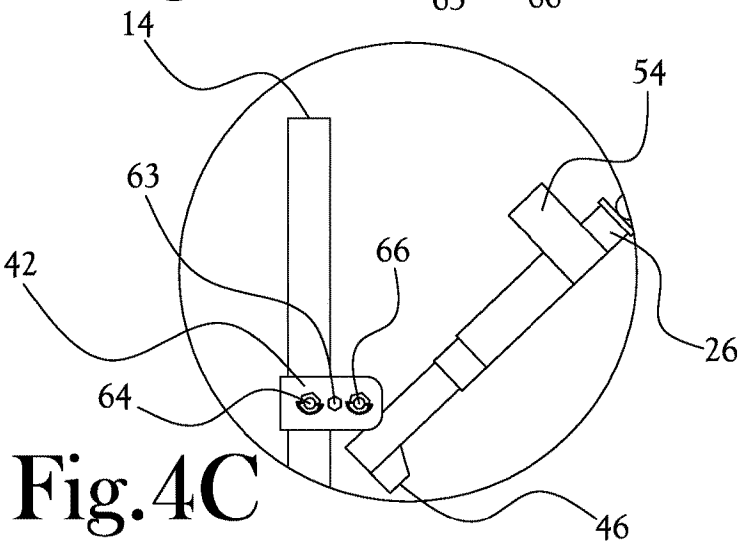

FIGS. 3A-B illustrate perspective views of a portion of the power winch equipment crane system 10 of FIGS. 2A-B in the stowed position according to an example embodiment of the present general inventive concept. As illustrated in this example embodiment, the securing member 50 is lowered along the side of the winch support bar 26 so that the hook portion 54 contacts the surface of the tractor roll bar 14 facing away from the winch support bar 26. In various example embodiments any further downward movement of the securing member 50 is limited by the contact between the hook portion 54 and the tractor roll bar, so that there will be no unwanted movement of the winch support bar 26 when in the stowed position. As the power winch support system 10 makes it easy and convenient for a user to hook up large farm implements such as brush hogs to a tractor, the securing member 50 is also easily moved into and out of the securing position by a single user. FIGS. 4A-D illustrate operations to position the power winch equipment crane system 10 of FIGS. 3A-B according to an example embodiment of the present general inventive concept. As illustrated in FIG. 4A, the winch support bar 26 is in the stowed position, as it is not in use, with the hook portion 54 of the securing member 50 contacting the tractor roll bar 14. When a user wishes to deploy the winch support bar 26 to place the winch 22 in position for use, the user can simply push upward on any component of the securing member 50, moving the hook portion 54 upward until it no longer contacts the tractor roll bar 14, and also will clear the tractor roll bar 14 when the winch support bar 26 is rotated toward a use position. The sliding motion of the securing member 50 is limited in an upward motion by the angled bend in the winch support bar 26. FIG. 4B illustrates the securing member 50 pushed up so that the hook portion 54 clears the tractor roll bar 14. As illustrated in FIG. 4C, once the securing member 50 has been moved to clear the tractor roll bar 14, the user can simply rotate the winch support bar down into place for use. FIG. 4D illustrates the winch support bar 26 fully rotated down to the position in which the stop members 46 contact the tractor roll bar 14, at which position the winch 22 is positioned for use with an implement.

Figure 5:
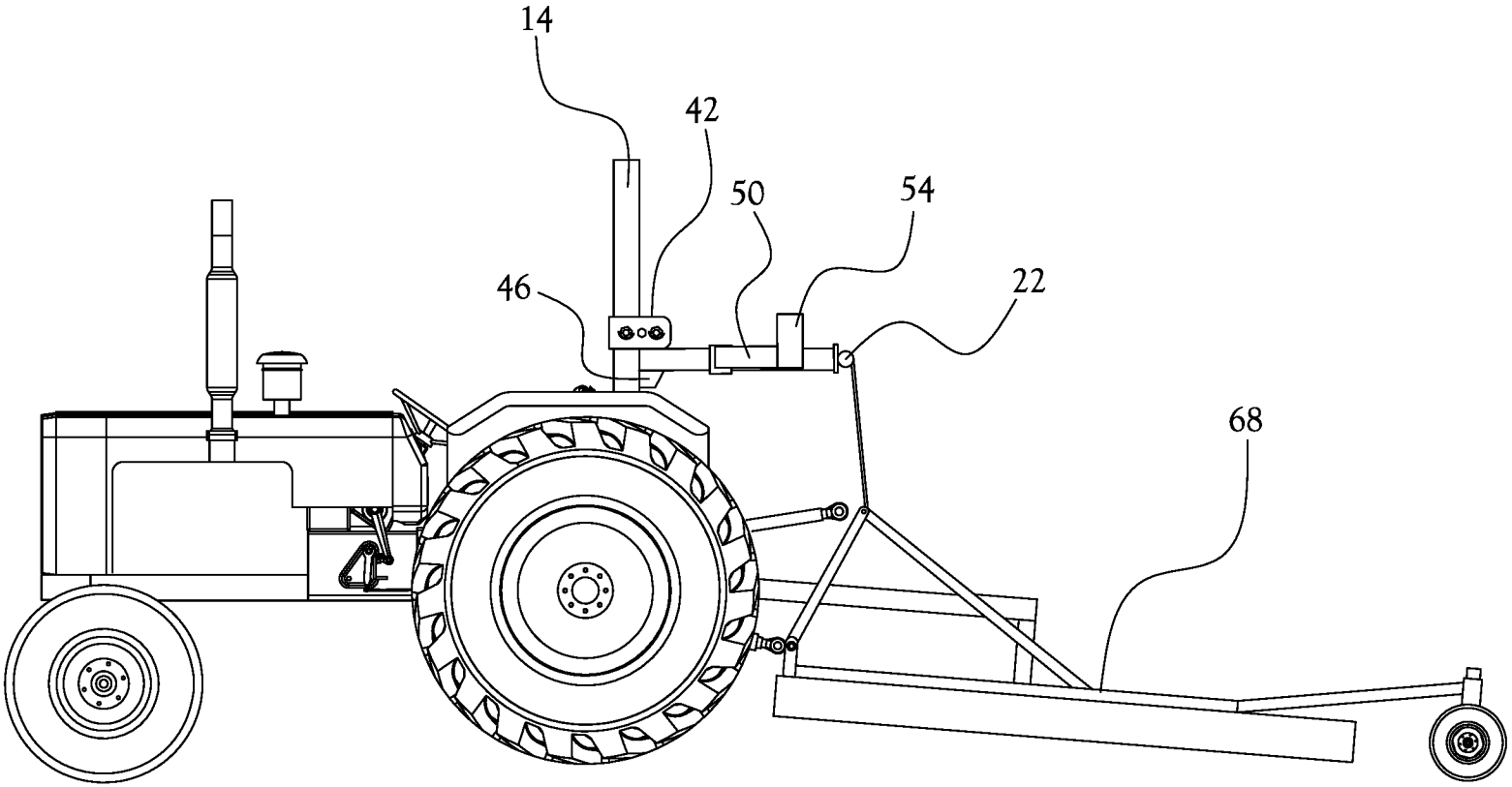
FIG. 5 illustrates a use of the power winch equipment crane system of FIGS. 2A-B.

FIG. 5 illustrates a use of the power winch equipment crane system of FIGS. 2A-B. As illustrated in FIG. 5, the power winch support bar 26 has been lowered to the use position, which in this example embodiment is substantially horizontal, so that the power winch 22 is located rear of the tractor 18 and over a farm implement 68. In the example embodiment illustrated in FIG. 5, a hook at the end of the cable of the power winch 22 has simply been connected directly to a part of the implement 68, allowing the implement 68 to be lifted so as to be easily connected to, and disconnected from, the various linkages and drive members of the tractor 18. Because the front end of the implement 68 has been raised to where the connection points are in close proximity to each other, the user is able to conveniently maneuver the connecting points, without any heavy lifting of the implement, thus enabling a user to hook up the implement without help from other people. It is noted that while the cable of the power winch 22 has been directly hooked to the implement 68 in the example embodiment illustrated in FIG. 5, various other implements may be more easily used by hooking the winch to a plurality of points on the implement. As will be described herein, various example embodiments of the present general inventive concept may also employ a chain or similar tool that is connected to various points on the implement to raise the entirety of the implement. For example, a chain may be threaded through a plurality of structural points of the implement and hooked to the cable of the power winch 22. In other example embodiments one or more coupling hooks may be fixed to the implement itself, either simply by contact or by one or more fixing members, to provide a more secure connection for the chain which is then hooked to the winch cable.

Figure 6:
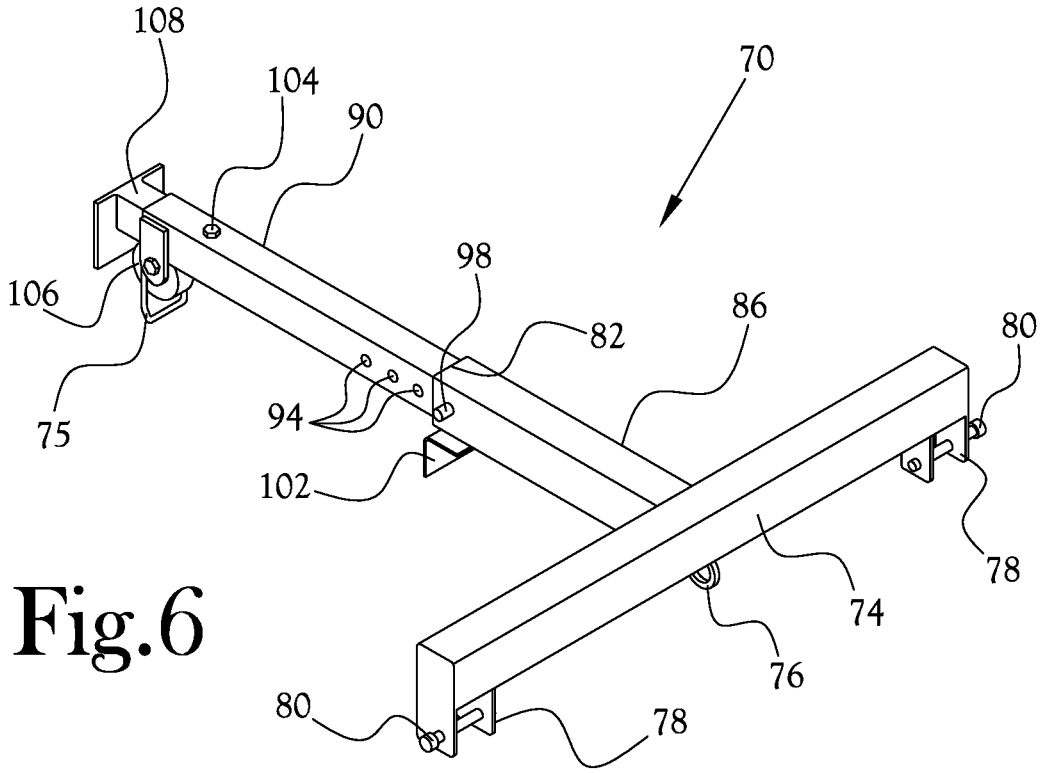
FIG. 6 illustrates a crane boom member to be used with a power winch equipment crane system according to another example embodiment of the present general inventive concept.
Figure 7:
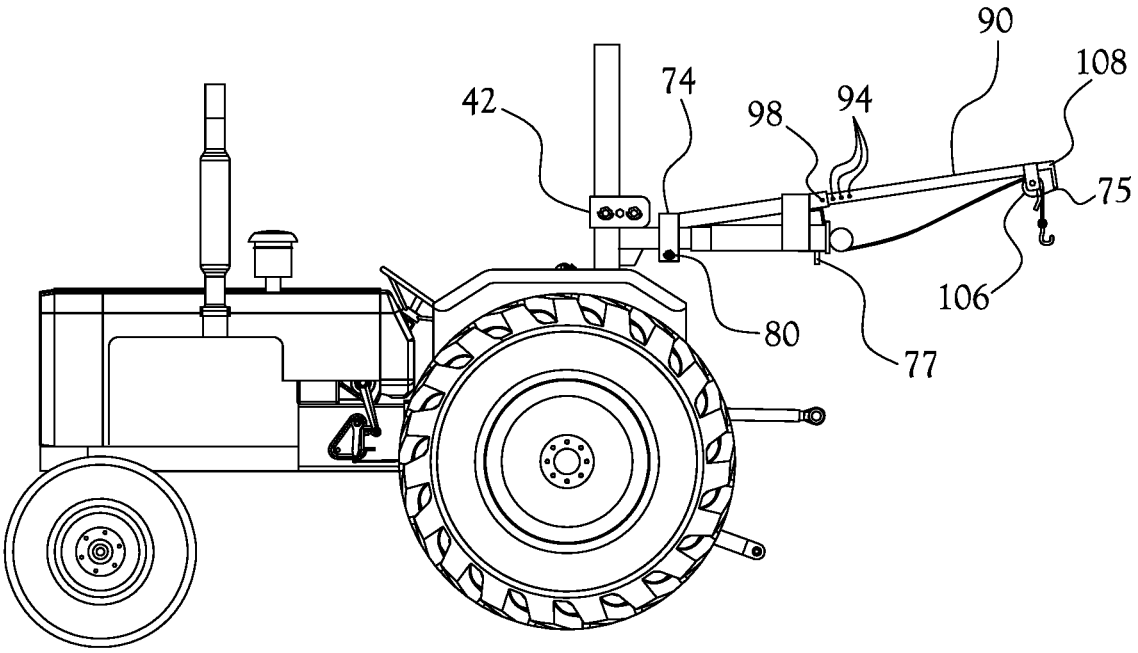
FIG. 7 illustrates the crane boom of FIG. 6 mounted on the power winch support system according to an example embodiment of the present general inventive concept.

With various implements that may be of a larger size and/or weight, there may be situations in which a user could more conveniently lift the implement from a suspension point that is further back from the tractor than the placement of the power winch 22 on the winch support bar 26. There may also be an added convenience when the suspension point is also at least slightly higher than the placement of the power winch 22. With such situations in mind, FIG. 6 illustrates a crane boom member to be used with a power winch equipment crane system according to another example embodiment of the present general inventive concept. As illustrated in FIG. 6, a crane boom 70 is provided to extend the suspension point of the system 10 further back from the tractor 18, and higher than the placement of the power winch 22, in the use position. A crane boom 70 according to an example embodiment of the present general inventive concept may include a crossmember mount 74 that is configured to span between the two side portions 30 of the winch support bar. Mounting brackets 78 are provided at each end of the crossmember mount 74 to attach the crane boom 70 to the side portions 30 of the winch support bar 26. As illustrated in FIG. 6, the mounting brackets 78 are configured to fit over the side portions 30 so that the crossmember mount 74 rests at each end on the winch support bar 26, and each mounting bracket 78 has receiving portions for pins 80 to secure the crossmember mount 74 to the winch support bar 26. One or more anchor points may be provided to the system to provide positions at which to hook the winch cable when in use with various attachments discussed herein. Such anchor points may be provided to the crane boom 70, the winch support bar 26, the winch 22 itself, and so on. For example, in FIG. 6 an anchor point 76 is provided proximate a mid-point of the crossmember mount 74 to provide a position at which to hook the winch cable when in use with various attachments discussed herein. A boom arm 82 extends from proximate a mid-point of the crossmember mount 74 in a direction away from the tractor roll bar 14. In this example embodiment, the boom arm 82 includes a boom arm base portion 86 that is attached directly to the crossmember mount 74, and a boom arm telescoping portion 90 that is configured to slide partially in and out of the boom arm base portion 86 to allow a user to select from different overall lengths of the boom arm 82. As illustrated in FIG. 6, the boom arm telescoping portion 90 is provided with a plurality of bolt receiving holes 94 along a length thereof which are configured to receive a bolt 98 that also passes through the distal end of the boom arm base portion 86. Proximate the distal end of the boom arm 82, and thus proximate the distal end of the boom arm telescoping portion 90, a pulley 106 is placed to support the cable from the power winch 22 when run therethrough. Another winch cable anchor point 75 is provided proximate the portion of the boom arm telescoping portion 90 supporting the pulley 106. A wire guide 108 may be provided at the distal end of the boom arm 82 to assure the winch wire stays in the pulley's track. The wire guide 108 may also be configured to move in a telescoping manner in and out of the distal end of the boom arm telescoping portion 90. With such a configuration, the wire guide 108 may be extended outward so as to allow the threading of the winch cable on the pulley 106, and then moved back into place to make sure the winch cable does not fall out of the pulley 106. A tightening bolt 104 may be provided on top of the boom telescoping portion 90 to assure that the wire guide 108 stays in place. The wire guide 108 also protects the pulley from the winch wire bending the pulley 106 when an off centered load is lifted. A riser portion 102 is provided proximate the distal end of the boom arm base portion 86, and is configured to contact the winch support bar 26 at an area near the power winch 22 so as to raise the boom arm 82 up and over the power winch 22 when attached to the winch support bar 26, so as not to interfere with the operation of the winch 22. FIG. 7 illustrates the crane boom 70 of FIG. 6 mounted on the power winch support system 10 according to an example embodiment of the present general inventive concept. As illustrated in FIG. 7, when the winch support bar 26 is lowered into position for the power winch 22 to be used, the crane boom 70 can be attached to the system by simply attaching the crossmember mount 74 to the winch support bar 26 when needed. A user can lay the crossmember mount 74 across the side portions 30 of the winch support bar 26 and pass the pins 80, such as lynch pins, through the mounting brackets 78 to secure the crossmember mount 74 in place. For added convenience, the boom arm telescoping portion 90 can be detached from the boom arm base portion 86 during the attachment to the winch support bar 26, as the riser portion 102 gives a third support point for the crossmember mount 74 and boom arm base portion 86. Once the pins 80 have been secured in the mounting brackets 78, the boom arm telescoping portion 90 can then be placed in the boom arm base portion 86, and the desired length of the boom arm 82 adjusted with the bolt 98 and bolt receiving holes 94. The cable of the power winch 22 can then be threaded onto the pulley 106, and a support point for operating the winch 22 is extended further back and higher than the winch 22 itself. Thus, as an example, when an implement such as an auger is higher than the power winch 22 when positioned for use, the crane boom 70 allows the auger attachment to be lifted into its mounting position on the tractor 18. The crane boom 70 attachment is designed to fit without any welding to the winch support bar 26. This allows easy and convenient attaching the crane boom 70 when needed, and then removing it for storage. The winch roller guides may be mounted at an angle on the winch mounting plate. This allows the wire to be more horizontal along the boom when using the crane boom attachment. The easily attachable/detachable crane boom is able to provide a longer cable path to move implements to the tractor, provide additional height to lift an augur or other tall implements, and can be used with a regular pulley at the end to lift various types of objects. In various example embodiments the winch cable can be anchored on the anchoring point 75 provided by the pulley at the end of the crane boom 70, and another pulley hook can be attached at the bottom of the loop formed in the cable. FIG. 7 also illustrates another anchor point 77 provided on the middle portion 34 of the winch support bar 26, to provide another point at which the end of the winch cable may be attached.

Figure 8A:
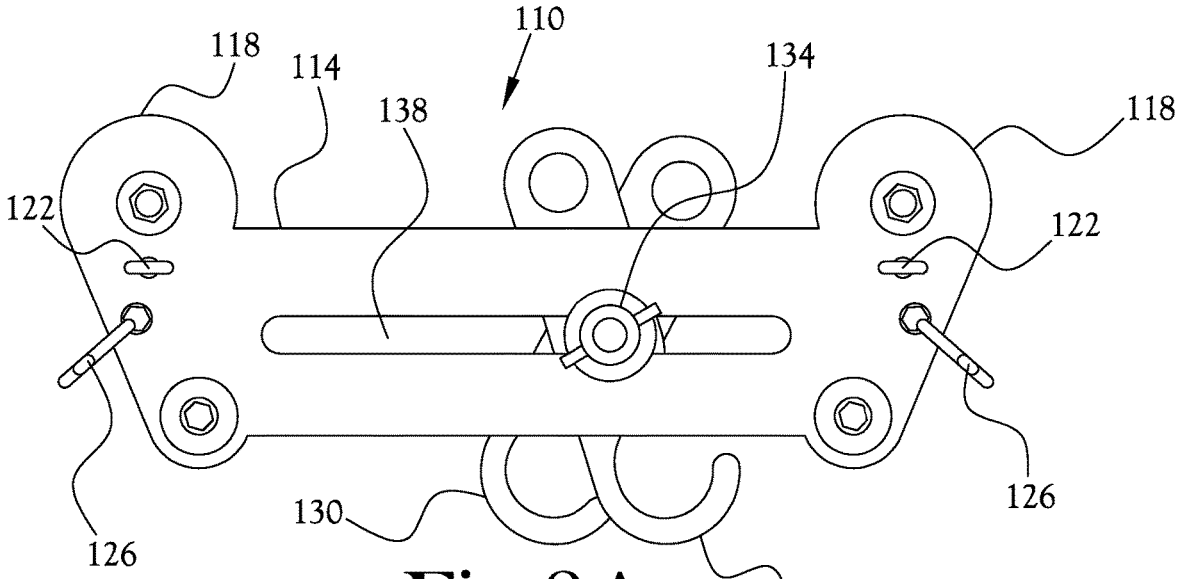
FIGS. 8A-C illustrate a sliding balance hook to be used with a power winch equipment crane system according to various example embodiments of the present general inventive concept.
Figure 8B:
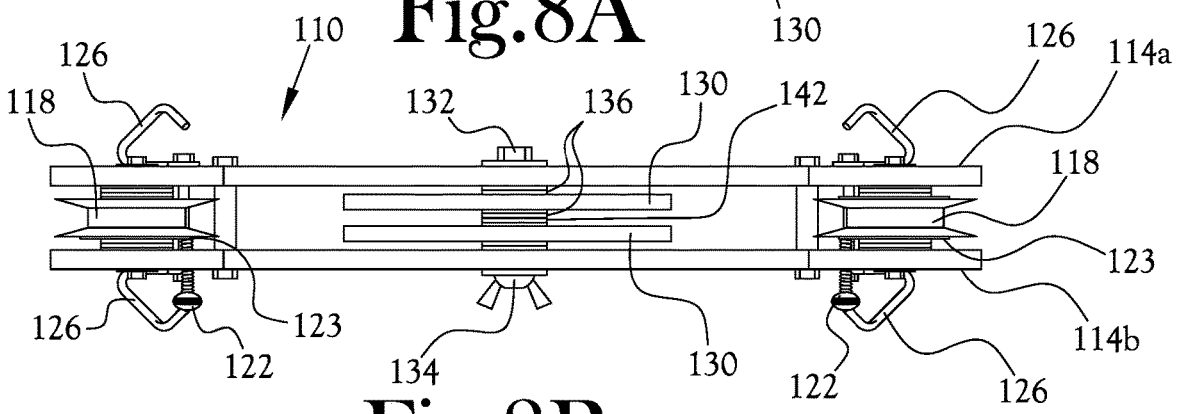
Figure 8C:
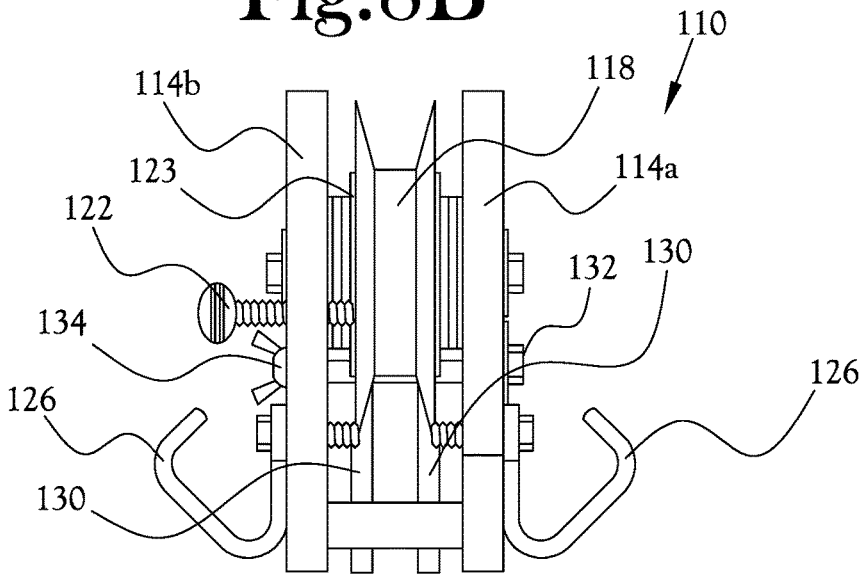

Various example embodiments of the power winch support system may include a variety of hooks and other attachments to be used with system 10. FIGS. 8A-C illustrate a sliding balance hook to be used with a power winch equipment crane system according to various example embodiments of the present general inventive concept. FIG. 8A illustrates a plan view of the sliding balance hook 110, FIG. 8B illustrates a top view of the sliding balance hook 110, and FIG. 8C illustrates an end view of the sliding balance hook 110. As illustrated in FIGS. 8A-C, the sliding balance hook 110 may be used in conjunction with the crane boom 70 to provide a plurality of points of support for a suspended implement. The sliding balance hook 110 includes an elongate body formed by two plates 114*a*,114*b* having a gap therebetween, having balance hook pulleys 118 respectively provided proximate each end, and sandwiched between the two plates 114*a*,114*b*. When installed on the winch cable, the cable passes underneath the pulleys 118. Each of the balance hook pulleys 118 may be provided with a tightening screw 122 configured to stop rotation of the respective balance hook pulleys 118 when tightened to a certain point by interacting with the balance hook pulleys 118, e.g., by the end of the tightening screw 122 contacting a portion of the balance hook pulleys 118 or a member attached to the balance hook pulleys. In this example embodiment a one inch washer is welded to each of the pulleys 118 as a brake disc 123, and the tightening screws 122 can be adjusted to contact the brake discs 123 with enough force to prohibit the pulleys 118 from rolling, thereby stabilizing the implement during installation and/or removal. One or more support hooks 126 are provided proximate each end of the sliding balance hook 110, and are configured to support chain links or other such suspension bodies used to support an implement. In this example embodiment, four support hooks 126 are provided, with one of the support hooks 126 respectively located on each side of each end of the sliding balance hook 110. One or more sliding support hooks 130 may be provided between the plates 114*a*,114*b*, and may be centered on a common pin 132 extending through a groove 138 in the plates so as to be slidable along a length of the groove 138. The sliding support hooks 130 may be spaced apart from one another and from the plates 114*a*,114*b* by washers 136 also centered on the pin 132. The sliding support hooks 130 may be selectively positioned along the groove 138 by loosening a tension nut 134 or other such tightening member that provides tension on the sliding support hooks 130 and washers 136 between the plates 114*a*,114*b*, sliding the sliding support hooks 130 to the desired position, and then tightening the tension nut 134 to prevent further movement of the sliding support hooks. The rotational position of the sliding support hooks can also be adjusted as desired before tightening the tension nut 134. Thus, when used with the crane boom 70, the winch cable can be threaded back through the balance hook pulleys 118, with the hook of the winch attached to the anchor point 76 provided on the crane boom 70, or to another point on the system 10, such as the power winch guide rollers, and the sliding balance hook 110 may then be positioned at various points along the cable to aid in the connecting of the implement. Since the winch cable is suspended from the pulley 106 of the crane boom 70 to the anchor point 76 on the crossmember mount 74 of the crane boom 70, the winch cable can be threaded though the balance hook pulleys 118 so that the sliding balance hook 110 can be positioned as desired along that span of cable. When in the desired position, the tightening screws 122 can be tightened to keep the sliding balance hook 110 in place, and the variety of support hooks 126 and sliding support hooks 130 may be used to support chains at different points to support an implement in a more balanced arrangement. The chains can be hooked to a variety of attachment hooks attached to the implement itself, either bolted on or otherwise temporarily adhered. Example attachment hooks may include a backhoe lifting attachment, a rotor tiller lifting hook, an auger lifting clamp, a brush hog lifting clamp, and so on.

The sliding balance hook 110 serves as the lifting point of the power winch equipment crane system when installed on the winch cable. The sliding balance hook 110 moves along the winch cable to raise the position of any implement being installed to the three point hitch. It provides the stabilization in both the height off of the ground and the horizontal movement needed to align the implement perpendicular to the tractor. The sliding balance hook 110 provides the ability to balance a load's weight along the balance hook 110 connection and stabilize any load it lifts as desired. The selection of which hook an installer uses is up to the person using the crane. The four support hooks 126 provide connection points for chains used with the system to lift implements. The chains are connected to the implement or load being lifted by the system. There are two brakes (one on each pulley), referred to as the tightening screws 122 above, to keep the load being lifted in a stationary position. The balance hook 110 uses the power winch's cable that is anchored to one of the anchoring points 75,76,77 provided at various points of the system. In some example embodiments there is also one or two anchoring points located on the winch roller guides. As the cable is lengthened or tightened it raises or lowers the balance hook 110. The winch cable is routed through the center of the balance hook 110, engaging the bottom of the two pulleys 118. The cable route is between the two sliding support hooks 130 in the center of the device. This route allows the free movement of the two sliding support hooks 130 along the horizontal slots 138. The thumb screw 134 is tightened in the slot 138 when the load is balanced. This action secures the load distribution along the cable when lifting an unbalanced load.

Figure 9:
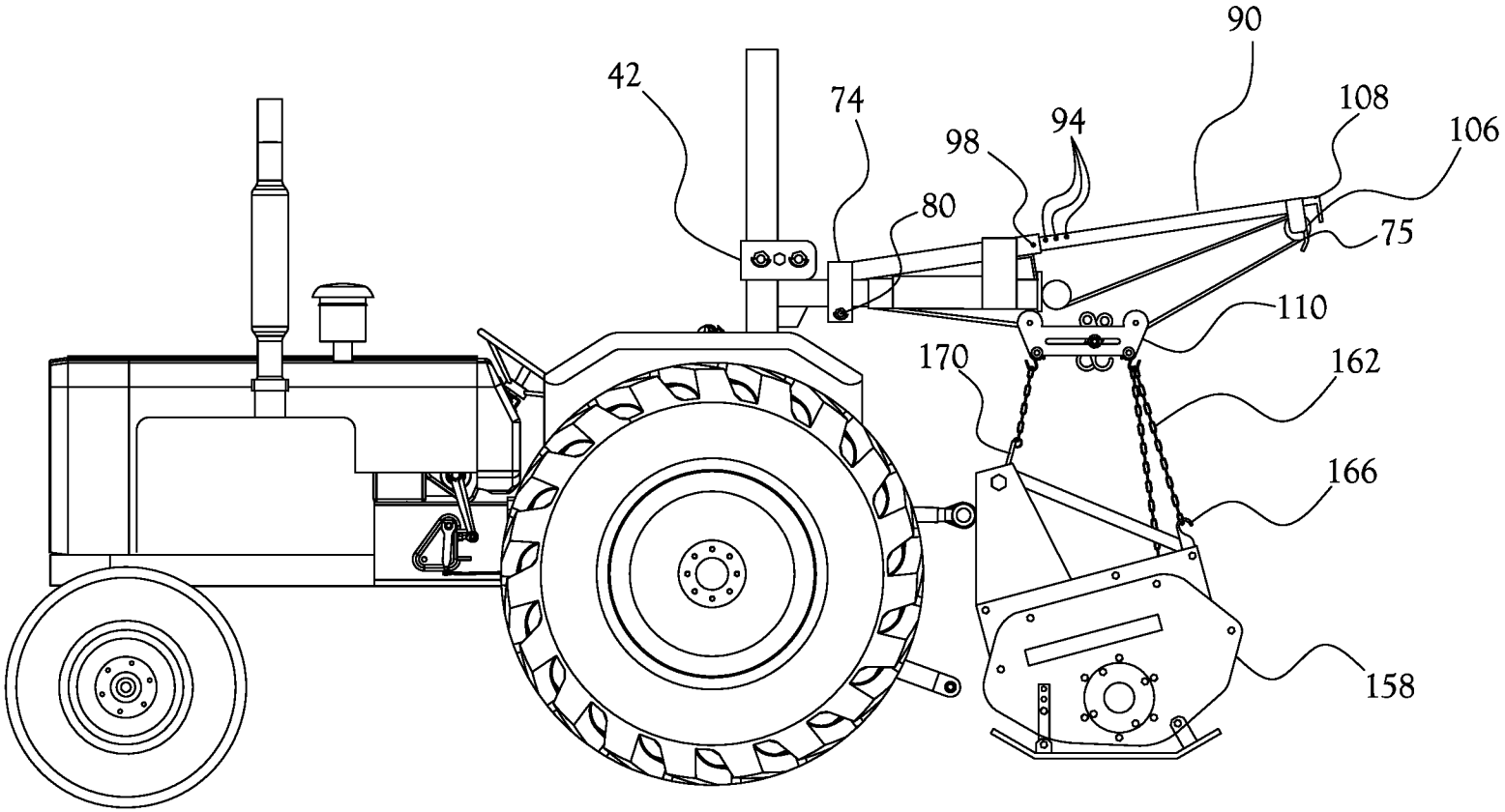
FIG. 9 illustrates a power winch system used with coupling hooks attached to an implement according to an example embodiment of the present general inventive concept.

FIG. 9 illustrates a power winch system used with coupling hooks attached to an implement according to an example embodiment of the present general inventive concept. As illustrated in FIG. 9, the winch support bar 26 has been lowered to place the power winch 22 in place for use, and the crane boom 70 has been attached to the winch support bar 26. The winch cable has been threaded from the power winch 22 through the pulley 106 of the crane boom 70, through the balance hook pulleys 118 of the sliding balance hook 110, and hooked into the anchor point 76 of the crane boom 70. The sliding balance hook 110 has been positioned at a point along a length of the winch cable that is substantially centered over a rotor tiller 158. Loops of a chain 162 have been attached to balance hooks 166 that are bolted to the rotor tiller 158, as well as to a rotor tiller lifting hook 170 attached proximate a front end of the rotor tiller 158, and to the support hooks 126 of the sliding balance hook 110. When the power winch 22 is turned on to draw the cable in, the rotor tiller 158 is lifted into a desired position. In various arrangements the tightening screws 122 of the sliding balance hook 110 may be loosened to allow the sliding balance hook to maintain the position above the rotor tiller 158 as the cable is drawn through the balance hook pulleys 118.

In various example embodiments of the present general inventive concept, the winch support system described herein may be formed integrally with the roll bar rather than retro-fitted onto an existing roll bar. The winch support system can also be conveniently detached from the roll bar when desired. In other various example embodiments, the winch support may be formed to act as the roll bar when in the vertical position, with the upper portion of the "roll bar" able to be rotated back to the horizontal position with the power winch installed thereon. In other various example embodiments, the power winch may be attached to the roll bar, and the pivotable support bar may include an alignment portion to support and align the cable coming from the power winch so that the cable extends down vertically over the implement from the alignment portion of the support bar, given a roll bar with the structural capability to support such an arrangement.

Embodiments of the present general inventive concept allow a single user to change out heavy equipment attached and detached form a tractor or other type vehicle with ease and convenience. Embodiments of the present general inventive concept also provide a host of other advantages. For example, as the whole system is separate from the tractor, there need to be no permanent connections, such as welding, to the tractor. This allows the winch support bar or crane to be easily attached and removed without damage to the tractor. In various example embodiments, the entire system may be attached to the roll bar by two number two—16 metric bolts hold the crane to the roll bar, and quick disconnect plugs can be used in the power leads to the winch. In various example embodiments no clamps are required to allow the crane to be raised and lowered from the roll bar. The power winch may be removed from the winch support bar and installed on a lower portion of the tractor, and various example embodiments may employ a tie bar with a mounting plate attached to the tow bar for the power winch. Off the shelf power winches may be used with the system. In various example embodiments, the power winch may be a 2,500 pound capacity power winch may be connected to the tractor's battery supply with size 10 wiring through a 50-amp breaker. Other various example embodiments may include differently rated and sized components, such as, for example, a 3,500 pound capacity power winch connected to the tractor's battery supply with size 6 wiring, and so on.

Various example embodiments of the present general inventive concept may provide a power winch equipment crane system to be used with a tractor roll bar, the system including a winch support bar configured to be generally U-shaped having two side portions and a middle portion connecting the two side portions, a power winch attached to the winch support bar proximate a midpoint of the middle portion of the winch support bar, and hinge members provided respectively proximate each end of the winch support bar and configured to couple the winch support bar to the tractor roll bar in a pivoting arrangement, the hinge members configured such that the winch support bar is pivotable between a substantially vertical position when not in use, and a substantially horizontal position in which the power winch is positioned at a point spaced back from the tractor so as to be located over an implement that is attachable to the tractor. The winch support bar may be shaped to correspond to at least a portion of the tractor roll bar. The system may further include stop members extending from the ends of the winch support bar and configured to contact the tractor roll bar to limit downward rotation of the winch support bar when in the substantially horizontal position. The system may further include at least one securing member attached to the winch support bar and configured to be selectively positioned so as to contact the tractor roll bar when the winch support bar is in the substantially vertical position to secure the winch support bar to prevent rotation. The at least one securing member may include a hook portion configured to contact a surface of the tractor roll bar facing away from the winch support bar when the at least one securing member is positioned to secure the winch support bar. The at least one securing member may further include a sleeve portion configured to wrap around the winch support bar and to be reciprocally slidable along a length of the winch support bar, the hook portion being attached to the sleeve portion. The sleeve portion may be configured to be reciprocally slidable to and from a first position that allows the winch support bar to be moved to and away from the substantially vertical position without the hook portion contacting the tractor roll bar, and a second position that allows the hook portion to contact the surface of the tractor roll bar facing away from the winch support bar when in the substantially vertical position. The sleeve portion may be configured to be reciprocally slidable along a first one of the side portions of the winch support bar. Movement of the sleeve portion in a direction toward the middle portion of the winch support bar may be limited by a bend between the middle portion and the first one of the side portions of the winch support bar. The system may further include coupling members configured to be attached to the tractor roll bar so as to extend back therefrom, and to connect to the hinge members of the winch support bar proximate the respective ends thereof to form the pivoting arrangement. The coupling members may be brackets configured to be welded to the tractor roll bar. The system may further include a crane boom configured to be selectively attached to, and detached from, the winch support bar, the crane boom including a crossmember mount configured to be attached at each end to the respective side portions of the winch support bar so as to sit thereon when the winch support bar is in the substantially horizontal position, a boom arm extending away from proximate a midpoint of the crossmember mount such that a distal end of the boom arm is positioned at a point farther away from the tractor roll bar than the power winch, and a pulley attached proximate the distal end of the boom arm and configured to support a cable of the power winch. The crane boom may further include a mounting bracket proximate each end of the crossmember mount, the mounting brackets being configured to extend below the winch support bar, and to receive a securing bolt below the winch support bar, to secure the crossmember mount to the winch support bar. The boom arm may include a boom arm base portion connected to the crossmember mount, and a boom arm telescoping portion extending from a distal end of the boom arm base portion and configured to slide in an axial direction relative to the boom arm portion such that the boom arm has an adjustable length. A portion of the boom arm telescoping portion may be configured to slide in and out of the distal end of the boom arm base portion to adjust the length of the boom arm, a proximal end of the boom arm telescoping portion being provided with a plurality of apertures formed along its length and configured to receive a position fixing pin passing through the boom arm base portion. The crane boom may further include a riser portion provided at a bottom of the boom arm and configured to contact the middle portion of the winch support bar so as to raise the boom arm to a position in which the pulley is positioned at a point higher than the power winch. The crane boom may further include a wire guide provided at the distal end of the boom arm to guard against the cable slipping off of the pulley, the wire guide being selectively positionable between a guard position proximate the pulley, and an away position extended away from the pulley. The crane boom may further include an anchor point formed on the crossmember mount and configured to receive a hook on an end of the winch cable. The system may further include a sliding balance hook configured to be supported on the winch cable when the winch cable from the power winch extends from the pulley back to the crossmember mount, the sliding balance hook including an elongate body, a balance hook pulley provided at each end of the elongate body, and a plurality of support hooks provided at points proximate a bottom of the elongate body and configured to support various points of the implement that is attachable to a tractor.

Various example embodiments of the present general inventive concept may provide a power winch equipment crane system to be used with a tractor roll bar, the system including a winch support bar configured to be generally U-shaped having two side portions and a middle portion connecting the two side portions, a power winch attached to the winch support bar proximate a midpoint of the middle portion of the winch support bar, hinge members provided respectively at each end of the winch support bar and configured to secure the winch support bar to a bracket on the tractor roll bar, the hinge members configured to form a pivoting connection to the winch support bar such that the winch support bar is pivotable between a substantially vertical position when not in use, and a substantially horizontal position in which the power winch is positioned at a point spaced back from the tractor, stop members extending from each end of the winch support bar and configured to contact the tractor roll bar when in the substantially horizontal position to brace the winch support bar against the tractor roll bar, and at least one movable securing member attached to the winch support bar and configured to be selectively positioned so as to contact the tractor roll bar to hold the winch support bar in the substantially vertical position.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A power winch equipment crane system to be used with a tractor roll bar, the system comprising:

a winch support bar configured to be substantially U-shaped having two side portions and a middle portion connecting the two side portions;

a power winch attached to the winch support bar proximate a midpoint of the middle portion of the winch support bar; and hinge members provided respectively proximate each end of the winch support bar and configured to couple the winch support bar to the tractor roll bar in a pivoting arrangement, the hinge members configured such that the winch support bar is pivotable between a substantially vertical position when not in use, and a substantially horizontal position in which the power winch is positioned at a point spaced back from the tractor so as to be located over an implement that is attachable to the tractor.

2. The system of claim 1, wherein the winch support bar is shaped to correspond to at least a portion of the tractor roll bar.

3. The system of claim 1, further comprising stop members extending from the ends of the winch support bar and configured to contact the tractor roll bar to limit downward rotation of the winch support bar when in the substantially horizontal position.

4. The system of claim 1, further comprising at least one securing member attached to the winch support bar and configured to be selectively positioned so as to contact the tractor roll bar when the winch support bar is in the substantially vertical position to secure the winch support bar to prevent rotation.

5. The system of claim 4, wherein the at least one securing member comprises a hook portion configured to contact a surface of the tractor roll bar facing away from the winch support bar when the at least one securing member is positioned to secure the winch support bar.

6. The system of claim 5, wherein the at least one securing member further comprises a sleeve portion configured to wrap around the winch support bar and to be reciprocally slidable along a length of the winch support bar, the hook portion being attached to the sleeve portion.

7. The system of claim 6, wherein the sleeve portion is configured to be reciprocally slidable to and from a first position that allows the winch support bar to be moved to and away from the substantially vertical position without the hook portion contacting the tractor roll bar, and a second position that allows the hook portion to contact the surface of the tractor roll bar facing away from the winch support bar when in the substantially vertical position.

8. The system of claim 7, wherein the sleeve portion is configured to be reciprocally slidable along a first one of the side portions of the winch support bar.

9. The system of claim 8, wherein movement of the sleeve portion in a direction toward the middle portion of the winch support bar is limited by a bend between the middle portion and the first one of the side portions of the winch support bar.

10. The system of claim 1, further comprising coupling members configured to be attached to the tractor roll bar so as to extend back therefrom, and to connect to the hinge members of the winch support bar proximate the respective ends thereof to form the pivoting arrangement.

11. The system of claim 10, wherein the coupling members are brackets configured to be welded to the tractor roll bar.

12. The system of claim 1, further comprising a crane boom configured to be selectively attached to, and detached from, the winch support bar, the crane boom comprising:

a crossmember mount configured to be attached at each end to the respective side portions of the winch support bar so as to sit thereon when the winch support bar is in the substantially horizontal position;

a boom arm extending away from proximate a midpoint of the crossmember mount such that a distal end of the boom arm is positioned at a point farther away from the tractor roll bar than the power winch; and a pulley attached proximate the distal end of the boom arm and configured to support a cable of the power winch.

13. The system of claim 12, wherein the crane boom further comprises a mounting bracket proximate each end of the crossmember mount, the mounting brackets being configured to extend below the winch support bar, and to receive a securing bolt below the winch support bar, to secure the crossmember mount to the winch support bar.

14. The system of claim 12, wherein the boom arm comprises:

a boom arm base portion connected to the crossmember mount; and a boom arm telescoping portion extending from a distal end of the boom arm base portion and configured to slide in an axial direction relative to the boom arm portion such that the boom arm has an adjustable length.

15. The system of claim 14, wherein a portion of the boom arm telescoping portion is configured to slide in and out of the distal end of the boom arm base portion to adjust the length of the boom arm, a proximal end of the boom arm telescoping portion being provided with a plurality of apertures formed along its length and configured to receive a position fixing pin passing through the boom arm base portion.

16. The system of claim 12, wherein the crane boom further comprises a riser portion provided at a bottom of the boom arm and configured to contact the middle portion of the winch support bar so as to raise the boom arm to a position in which the pulley is positioned at a point higher than the power winch.

17. The system of claim 12, wherein the crane boom further comprises a wire guide provided at the distal end of the boom arm to guard against the cable slipping off of the pulley, the wire guide being selectively positionable between a guard position proximate the pulley, and an away position extended away from the pulley.

18. The system of claim 12, wherein the crane boom further comprises an anchor point formed on the crossmember mount and configured to receive a hook on an end of the winch cable.

19. The system of claim 12, further comprising a sliding balance hook configured to be supported on the winch cable when the winch cable from the power winch extends from the pulley back to the crossmember mount, the sliding balance hook comprising:

an elongate body;

a balance hook pulley provided at each end of the elongate body; and a plurality of support hooks provided at points proximate a bottom of the elongate body and configured to support various points of the implement that is attachable to a tractor.

20. A power winch equipment crane system to be used with a tractor roll bar, the system comprising:

a winch support bar configured to be substantially U-shaped having two side portions and a middle portion connecting the two side portions;

a power winch attached to the winch support bar proximate a midpoint of the middle portion of the winch support bar;

hinge members provided respectively at each end of the winch support bar and configured to secure the winch support bar to a bracket on the tractor roll bar, the hinge members configured to form a pivoting connection to the winch support bar such that the winch support bar is pivotable between a substantially vertical position when not in use, and a substantially horizontal position in which the power winch is positioned at a point spaced back from the tractor;

stop members extending from each end of the winch support bar and configured to contact the tractor roll bar when in the substantially horizontal position to brace the winch support bar against the tractor roll bar; and at least one movable securing member attached to the winch support bar and configured to be selectively positioned so as to contact the tractor roll bar to hold the winch support bar in the substantially vertical position.

* * * * *